United States Patent [19]

Norris et al.

[11] 4,083,172

[45] Apr. 11, 1978

[54] CONTROL SYSTEM FOR PNEUMATICALLY TREATED YARNS

[75] Inventors: Alan H. Norris; Phillip W. Chambley, both of Rome, Ga.

[73] Assignee: Champion International Corporation, Stamford, Conn.

[21] Appl. No.: 791,837

[22] Filed: Apr. 28, 1977

[51] Int. Cl.[2] ..... D01H 7/92; D02G 1/04

[52] U.S. Cl. ..... 57/34 AT; 28/276; 57/77.3

[58] Field of Search ..... 57/34 B, 34 AT, 77.3, 57/157 F; 28/104, 271, 276

[56] References Cited

U.S. PATENT DOCUMENTS 3,775,955 12/1973 Shah ..... 57/34 AT

*Primary Examiner*—Richard C. Queisser
*Assistant Examiner*—Charles Gorenstein
*Attorney, Agent, or Firm*—Evelyn M. Sommer

[57] ABSTRACT

A control system for the pneumatic treatment of yarns, for example, self-twist yarns, includes a pneumatic-hydraulic transducer which converts a control signal related to the speed of the yarn supply means into variations in hydraulic pressure. The transducer is connected to a hydraulic manifold which has branch hydraulic lines leading to hydraulically controlled pneumatic valves. The pneumatic valves control the flow of compressed air to yarn air treatment devices such as jet twister devices.

10 Claims, 3 Drawing Figures

CONTROL SYSTEM FOR PNEUMATICALLY TREATED YARNS

BACKGROUND OF THE INVENTION

The present invention relates to a combined mechanical, hydraulic and pneumatic control system to control the delivery of air pulses to the jet air twist devices in a yarn production system.

In the use of yarn, particularly artifical fibers, it is sometimes desirable that the yarn have bulk which may add to its appearance, wearability and texture. It has been suggested that a desirable method of yarn processing is to give each individual strand of yarn a "false-twist", in which a strand is twisted at a point generating opposite twists above and below the point of twisting the yarn, which is its "node". Each of the "false-twist" yarns has both an "S" twist and a "Z" twist, the "S" and "Z" referring to the direction of the helices of the twisted strands.

It has also been suggested that there be a joinder and locking of two of the false-twisted yarns at their nodes, for example, by plying the two yarns together to form a "self-twist" yarn.

In the applicants' copending prior application Serial No. 755,671, entitled "Self-Twist Plural Yarn Strand System", filed Dec. 30, 1976, the subject matter of which is incorporated by reference herein, slivers of yarns from separate sliver containers are pulled between drafting rolls to draw the yarn, and the drawn yarn strands are each brought to a primary twist jet. The yarn is then brought to false-twist jets which form a false-twist yarn, and then to a wire guide. The wire guide positions the two strands over a yarn wheel which carries an abrasive rotating disc, the direction of rotation being about a radius of the yarn wheel. The abrasive disc plies together the two yarns at the nodes. The joined yarn may then be pulled through a heat-setting apparatus and wound on a bobbin. That application, at its FIGS. 7 through 11, as filed, describes one embodiment of a vortex jet device which produces a false twist of a single yarn before locking and self-twisting. The jet device has two inlets to permit control of twist in both the "S" and "Z" directions.

Other designs of pneumatic vortex jet devices for producing a false twist or a twist between two yarns or the joining of two or more yarns have also been shown in various prior patents; for example, such fluid jet false twisting devices are shown in U.S. Pat. No. 2,515,299 to B. H. Foster et al.; U.S. Pat. No. 3,079,745 to A. L. Breen et al.; U.S. Pat. No. 3,116,588 to A. L. Breen et al.; U.S. Pat. No. 3,206,922 to K. Nagahaha et al.; U.S. Pat. No. 3,940,917 to D. R. Strachan; and U.S. Pat. No. 3,353,344 to F. J. Clendening, Jr. In FIG. 5 of the Clendening patent there is shown a multiplicity of such jet twisters, all of which operate from a common source of air. In U.S. Pat. No. 3,775,955 to J. J. Shah, a jet block receives air from a common source. The air is delivered through four air lines, each of which is separately controlled by an electric solenoid switch, the switches being controlled in turn by a set of cams.

A difficulty with the type of control apparatus shown in the Shah '955 patent would be that the length of tubings between the compressed air source and the plurality of twisting jet devices is unequal; that is, some of the compressed air lines are longer than other of the compressed air lines. Since air is a compressible fluid, there may occur a large difference in transport time between the control devices, which, in the case of Shah, are the solenoids, and the outlets of the air lines. This difference of timing may result in a non-uniformity of yarn twist. For example, even though the timing of the cams or solenoids or other control devices may be reasonably accurate and in phase with the yarn supply and node plying devices the timing of the air pulses at the twisting jet devices may be non-uniform. Such non-uniformity and lack of precision control makes it difficult to exactly control the spacing between the nodes. Exact uniformity of node length may be quite important, since the plying device, for example, a rotating knob, must hit the strands exactly at the nodes. If the length of the air lines differs, then the twisting jet devices closest to the air switches or other air control devices will respond relatively sooner and those further away will respond later.

It is difficult, if not impossible, to take account of that difference in timing by means of the control mechanism, for example, by repositioning the cams, since the degree of lateness depends on many factors, such as tubing diameter, tubing length, and changes of air pressure. Under some circumstances, where the tubing is particularly long, it may occur that, due to the length of transportation time between the control device and the vortex twist jet device, two or more opposite air pulse signals may occur within the interconnecting tubing at the same time. In the case of a duo-directional vortex jet, both the "S" and "Z" modes may operate simultaneously and no useable yarn twist would result since the air pulses would be in opposite directions.

FEATURES AND OBJECTIVES OF THE PRESENT INVENTION

It is an objective of the present invention to provide a control system for pneumatically twisting yarns, which provides a uniform control of the timing and direction of the twist air pulses at a plurality of vortex jet devices.

It is a further objective of the present invention to provide such a system in which there is a uniformity in the yarn delivery positions and the vortices are operated by a common control.

It is a further objective of the present invention to provide such a system which will operate in a relatively troublefree manner in the adverse environment of a textile mill.

It is a further objective of the present invention to provide such a system which will assure the exact desired number and length of "S-twists" and "Z-twists" to each of the yarn pairs passing through the system, and furthermore will locate the nodes at exact and uniform locations so that they may be subsequently plied at those nodes.

It is a further objective of the present invention to avoid any cancellation or degradation of the air pulse necessary to obtain the desired "S" or "Z" twists, and particularly to avoid cancellation of the air pulses in opposite directions at the vortex devices.

It is a feature of the present invention to provide a system for the pneumatic twisting of yarn, in which the yarn supply means has a variable speed. A first and a second yarn twist air device, such as a pneumatic self-twist duo-directional vortex jet, receives yarn from the yarn supply means and imparts a twist to the yarn by a flow of air. The air flow is obtained from a source of compressed air, and a first and a second air line, respectively, connect the twist air devices to the source of compressed air.

First and second hydraulically controlled pneumatic valves, which are respectively in the first and second air lines, control the flow of compressed air to the yarn twist air devices. Those pneumatic valves provide a timed sequence of air flow. The first hydraulically controlled air valve is normally open and the second hydraulically controlled air valve is normally closed.

A hydraulic transducer, such as a pneumatic-hydraulic transducer, converts a control signal into a rise in hydraulic pressure. A hydraulic line connects the hydraulic transducer to the first and second hydraulically controlled pneumatic valves; and a signal means, connected to the yarn supply means and the transducer, provides a control signal, which is dependent upon the speed of the yarn supply means, to the transducer.

It is a further feature of the present invention to provide a control system for the pneumatic twisting of yarn in which the control signal is obtained using a rotating shaft driven by the yarn supply means and a cam fixed to that shaft. A fluidic proximity switch is connected to the source of compressed air and has a control port in proximity to the cam. The compressed air pressure at the output port of the fluidic proximity switch is responsive to movement of the cam, and the change in air pressure at that output port control the hydraulic valves.

BRIEF DESCRIPTION OF THE DRAWINGS

Other objectives of the present invention will be apparent from the following detailed description providing the best mode of practicing the invention known to the inventors at this time, which detailed description should be taken in conjunction with the accompanying drawings.

In the drawings.

DETAILED DESCRIPTION OF THE INVENTION

Figures 1, 2, 3:
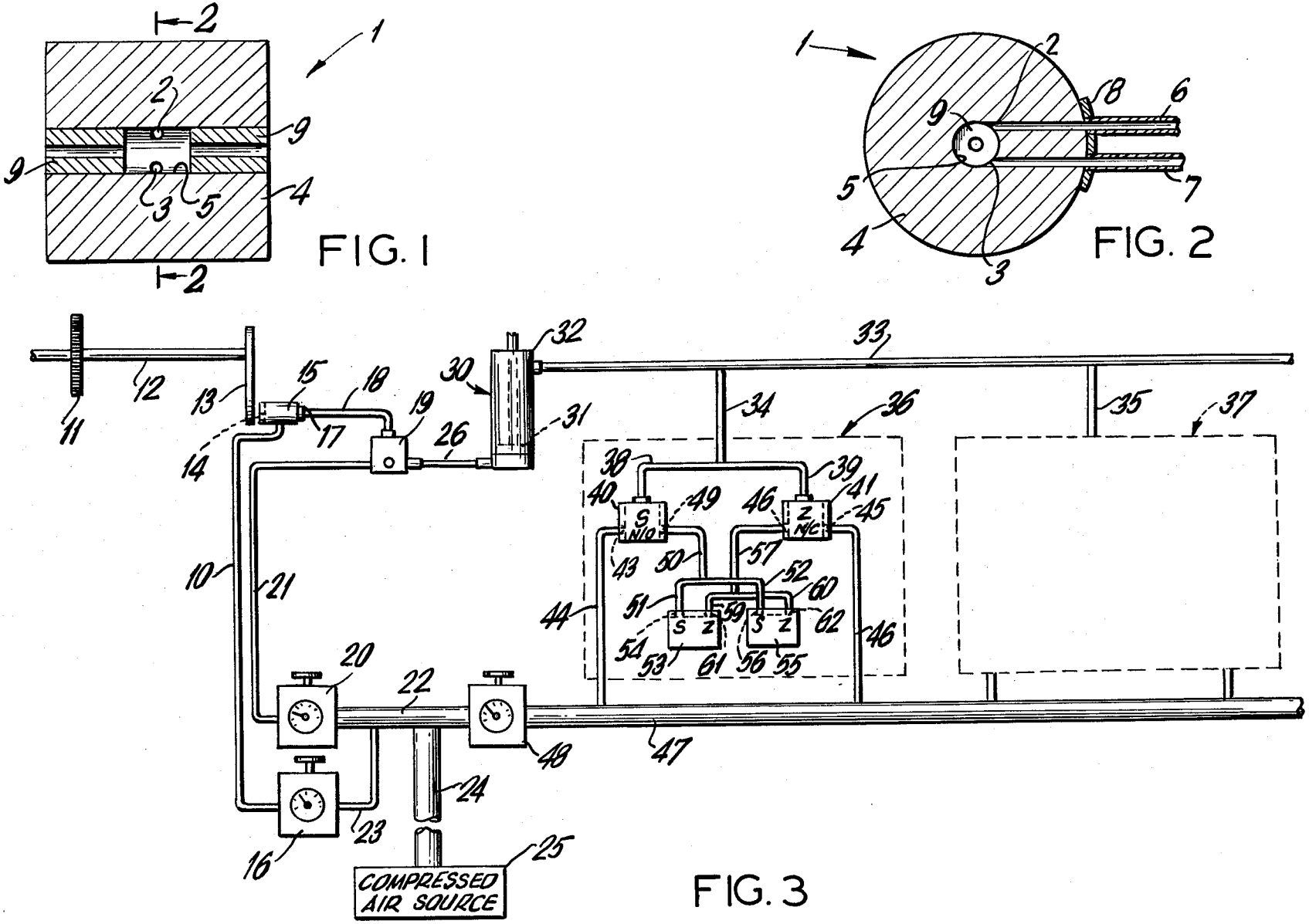
FIG. 1 is an elevation side cross-sectional view of a duo-directional vortex jet air false twist device which is one type of jet twist device that may be used in connection with the invention.
FIG. 2 is a sectional view along lines 2—2 of FIG. 1.
FIG. 3 is a schematic diagram showing the control system of the present invention.

As shown in FIGS. 1 and 2, the fluid jet twisting device used in connection with the present invention may provide an "S-twist" or a "Z-twist" to a yarn. The twisting jet device 1 is "duo-directional" in that it has separate tangential jet inlets 2 and 3 to impart "S" and "Z" twists to the yarn. The fluid used in twisting jet device 1 is compressed air which is timed to enter either through inlet 2 or inlet 3 in alternating sequence. The jet device 1 has a body 4 having a central bore 5. The air is supplied to inlets 2 and 3 by the respective conduits 6 and 7, which are held in place by a mounting plate 8. The opposite ends of the bore 5 have annular inserts 9 each having a bore out of which flows the compressed air used to twist the yarn.

As shown in FIG. 3, the control system of the present invention comprises mechanical, hydraulic and pneumatic elements. The control signal timing for the control mechanism is by a mechanical connection to the yarn delivery rolls or alternatively to the yarn treatment device. A suitable mechanical connection is a gear 11 which meshes with a gear (not shown) driven directly or indirectly by a shaft of the yarn delivery roll.

The gear 11 is fixedly mounted on a rotatable shaft 12 mounted in bearing blocks (not shown). A cam 13 is fixedly mounted on the free end of the shaft 12. The cam rotates in one direction, for example, clockwise, and the speed of the rotation is determined by the rotative speed of the yarn delivery roll. The cam 13 is a semi-circle and its solid portion is sequentially positioned in front of an orifice 14 of a fluidic proximity switch 15. The fluidic proximity switch 15 is supplied with a constant supply of compressed air through an air line 10 which is connected to a pressure regulator 16. The pressure regulator 16 may be set by the operator to maintain a constant air pressure, which is preferably in the range of 2 to 10 pounds per square inch, to the fluidic proximity switch 15. The fluidic proximity switch 15 has an output signal port 17 which is connected to an air line 18.

The semi-circular cam 13, during one-half of its revolution, obstructs the orifice 14 of the fluidic proximity switch 15, creating a pressure rise at its output signal port 17. During the other half revolution of the cam 13, the orifice 14 is unobstructed and consequently there is not an output air signal at the signal port 17. A suitable fluidic proximity switch may be obtained from Johnson Control Company of Milwaukee, Wisconsin, under Type FSP-102.

The pneumatic air line 18 is connected to a fluidic air valve 19 to control the operation of that valve. Such valve may be the Type FON-201 of Johnson Control Company, Milwaukee, Wisconsin. The fluidic valve 19 is supplied with constant compressed air pressure through air line 21, which line 21 is connected between the fluidic valve 19 and a settable air pressure regulator 20. The settable air pressure regulator 20, at its inlet, is connected by means of air line 22 to the main air line 24. Similarly, the pressure regulator 16 is connected through the air branch lines 23 and 22 to the air main line 24. The air main line 24 is connected to a compressed air source 25, such as an air pump reservoir.

The fluidic valve 19 is connected to an outlet line 26 which is connected to the air input of a pneumatic-hydraulic transducer 30. The fluidic valve 19 will furnish an on-off pulse of air through the air line 26 and the timing of that on-off air pulse is determined by the rotative speed of the cam 13. The pneumatic-hydraulic transducer 30 may be of various types. For example, it may include a casing 32 having therein a piston 31 which slides within the internal wall of the casing 32. Air pressure through the line 26 will enter the bottom portion of the transducer 30 and drive the piston 31 against a hydraulic fluid above the piston and in the upper portion of the casing 32. The air on-off pulse is converted by the transducer 30 to pulses (rises in pressure) of hydraulic fluid. Since the hydraulic fluid is not compressible, those pulses may be transmitted for a relatively long distance with accurate timing. The output of the transducer 30 is a series of pulses, i.e., rises and falls in the hydraulic fluid pressure, whose timing is determined by the rotative speed of the cam 13. A number of hydraulic fluids are available, and an oil-based hydraulic fluid is preferred.

The hydraulic chamber of the transducer 30 is connected to the hydraulic manifold line 33, which has two branches 34 and 35. It will be understood that additional branches of the hydraulic manifold line 33, for the control of additional twist devices, may be utilized. The hydraulic branch line 34 leads to the twist mechanism 36 shown within the dashed lines. The dashed lines 37 indicate that the mechanism within the dashed lines 37 is a duplicate of the mechanism within the dashed lines 36. It will be understood that additional twist mechanisms, which are duplicates of the twist mechanism 36, may be added and controlled by means of the hydraulic pulses received through the hydraulic manifold line 33.

The hydraulic branch line 34 is branched into two branch hydraulic lines 38 and 39. The branch hydraulic line 38 is a control line and is connected to a fluidic valve 40 labeled "S". Similarly, the branch hydraulic line 39 leads to and controls the fluidic valve 41 labeled "Z". The fluidic valve 40 is a normally open valve so that, in the absence of a rise in fluidic pressure through the line 38, its input port 43 is in open communication with its output port 49, allowing the free passage of compressed air. The fluidic valve 41 is a normally closed valve. In the absence of a rise in hydraulic pressure through the branch line 39, the valve 41 will be closed so that its input port 45 will not be in communication with its output port 46. The fluidic valves 40, 41 may suitably be of the Type 2012 from Johnson Control Company of Milwaukee, Wis. These valves 40,41 are controlled, opened and closed upon receipt of hydraulic pressure from the hydraulic manifold line 33 and control the through-put of compressed air from an input port to an outlet port. The input port 43 of the fluidic valve 40 is connected through the air line 44 to the twist air manifold 47 which, in turn, is connected through the pressure regulator 48 to the main air line 24. Similarly, the fluidic valve 41 has its input port 45 connected through the air line 46 to the twist air manifold 47. The output port 49 of the fluidic valve 40 is connected through the air line 50 and branches into the branch air lines 51 and 52. The air line 51 is connected to the "S" port 54 of a twist air device 53 and the branch air line 52 is connected to the "S" port 56 of the twist air device 55. Similarly, the output port 46 of the fluidic valve 41 is connected through the air line 57 and through its branch lines 59 and 60 to the respective "Z" ports 61 and 62 of the twist air devices 53 and 55.

In operation, the shaft 12 is rotated at a speed which is in direct relationship to the speed of the yarn supply means. The mechanical connection to the shaft 12 is by means of the gear 11. The rotation of the cam 13, which is positioned next to the fluidic proximity switch 15, causes the orifice of the fluidic proximity switch 15 to be alternately closed and opened in timed relationship to the yarn supply means. The fluidic proximity switch 15 controls the operation of the air valve 19 which, in effect, acts as an amplifier of the timed air pulses from the fluidic proximity switch 15. The timed air pulses from the air valve 19 operate the pneumatic-hydraulic transducer 30 and cause timed rises and falls in hydraulic pressure within the hydraulic manifold line 33. Such rises in hydraulic pressure are immediately communicated through the manifold line 33 and its branch lines 34, 35 and the branch lines 38 and 39 of the branch line 34 to the fluidic valves 40 and 41. In the case of the normally open fluidic valve 40, the rise in the hydraulic control pressure causes the valve to close, thereby blocking the flow of air through the fluidic valve 40. Conversely, in the case of the fluidic valve 41, the same rise in the controlling hydraulic pressure causes the normally closed valve 41 to open, permitting a flow of air from the air manifold and through the air line 46, through the fluidic valve 41, and into the air line 57 and its branch air lines 59 and 60. The air through the branch lines 59 and 60 exits through the "Z" ports 61, 62 of the twist air devices 53, 55 causing a "Z" twist in yarn passing through those twist air devices 53, 55. The fall in hydraulic pressure at the hydraulic manifold line 33 causes the normally closed fluidic valve 41 to close, terminating the pulse of air through the "Z" ports 61, 62. At the same time, the normally open fluidic valve 40 is opened, allowing air from the air manifold 47 to pass through the air line 44 and the air line 50 and its branch lines 51 and 52. The air from the branch lines 51 and 52 is propelled through the "S" ports 54 and 56 of the respective twist air devices 53 and 55. The propulsion of the air through the "S" ports 54 and 56 causes an "S" twist in the yarn passing through the twist air devices 53,55.

It is thus seen that an exact and accurate timing of the change of air necessary to cause an "S" twist, followed by a "Z" twist, or a "Z" twist followed by an "S" twist, is accomplished by means of the combined mechanical, hydraulic and pneumatic control system of the present invention.

What is claimed is:

1. A system for the twisting of yarn, comprising a variable speed yarn supply means, a first and a second yarn twist air device to receive yarn from said yarn supply means and to impart a twist to said yarn by a flow of air, a source of compressed air, a first and a second air line respectively connecting said first and second twist air devices to said source of compressed air, first and second hydraulically controlled air valves respectively in said first and second air lines to control the flow of compressed air to said yarn twist air devices and provide a repeated sequence of a timed period of air flow followed by a timed period of no air flow, said first hydraulic controlled air valve being normally open and being closed by a rise in hydraulic pressure and said second hydraulically controlled air valve being normally closed and being opened by a rise in hydraulic pressure, control signal means connected to said yarn supply means to provide a control signal dependent upon the speed of said yarn supply means, a hydraulic transducer connected to said control signal means to convert said control signal into a rise in hydraulic pressure, and a hydraulic line connecting said hydraulic transducer to said first and said second hydraulic controlled air valves.

2. A system for the twisting of yarn as in claim 1 wherein said hydraulic transducer is a pneumatic-hydraulic transducer, said control signal means includes a rotating shaft driven by the yarn supply means, a cam fixed to said shaft, and a fluidic proximity switch connected to said source of compressed air and having a control port in proximity to said cam and an output port, the compressed air pressure at output port being responsive to movement of said cam.

3. A system for the twisting of yarn as in claim 2 and further including an air pressure-operated fluidic valve having an inlet port, an outlet port and a control port, an air line connecting said inlet port to said source of compressed air, an air line connecting said control port to said output port of said fluidic proximity switch, and an air line connecting said fluidic valve outlet port to said pneumatic-hydraulic transducer.

4. A system for the twisting of yarn as in claim 1 wherein said hydraulic transducer is a pneumatic-hydraulic transducer in which a rise in pneumatic pressure is converted to a rise in hydraulic pressure.

5. A system for the twisting of yarn as in claim 1 wherein each of said twist air devices is a pneumatic vortex jet having two air inlet ports for respectively S and Z twists and each of said air inlet ports is connected to one of said controlled air valves.

6. A system for the twisting of yarn as in claim 1 and further including a settable air pressure regulator connected between said source of compressed air and said twist air devices.

7. A system for the twisting of yarn, comprising a variable speed yarn supply means, first and second pneumatic vortex yarn twist jets to receive yarn from said yarn supply means and to impart a twist to said yarn by a flow of air, a source of compressed air, a first and a second air line respectively connecting said twist jets to said source of compressed air, first and second hydraulically controlled air valves respectively in said first and second air lines to control the flow of compressed air to said yarn twist jets and provide a timed and repeated sequence of a period of air flow followed by a period of no air flow, said first hydraulic controlled air valve being normally open and said second hydraulic controlled air valve being normally closed, signal means connected to said yarn supply means to provide a pneumatic control signal dependent upon the speed of the yarn supply means, a pneumatic hydraulic transducer connected to said signal means to convert said pneumatic control signal into a rise in hydraulic pressure and a hydraulic line connecting said pneumatic-hydraulic transducer to said first and second hydraulically controlled air valves.

8. A system for the twisting of yarn as in claim 7 wherein said signal means includes a rotating shaft driven by the yarn supply means, a cam secured to said shaft, a fluidic proximity switch connected to said source of compressed air and having a control port in proximity to said cam and an output port, an air pressure-operated fluidic valve having an inlet port, an outlet port and a control port, an air line connecting said inlet port to said source of compressed air, an air line connecting said control port to said output port of said proximity switch, and an air line connecting said fluidic valve outlet port to said transducer.

9. A system for the twisting of yarn as in claim 7 wherein each of said twist jets has two air inlet ports for respectively S and Z twists and each of said ports is connected to one of said controlled air valves.

10. A system for the twisting of yarn as in claim 7 and further including a settable air pressure regulator connected between said source of compressed air and said twist jets.

* * * * *